US009952542B2

(12) United States Patent
Kudo et al.

(10) Patent No.: US 9,952,542 B2
(45) Date of Patent: Apr. 24, 2018

(54) FIXING APPARATUS AND IMAGE FORMING APPARATUS

(71) Applicant: CANON KABUSHIKI KAISHA, Tokyo (JP)

(72) Inventors: Yoshiki Kudo, Mishima (JP); Koji Uchiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/277,061

(22) Filed: Sep. 27, 2016

(65) Prior Publication Data

US 2017/0097598 A1 Apr. 6, 2017

(30) Foreign Application Priority Data

Oct. 5, 2015 (JP) ..... 2015-197957

(51) Int. Cl.
*G03G 15/20* (2006.01)

(52) U.S. Cl.
CPC ..... *G03G 15/2064* (2013.01); *G03G 15/2053* (2013.01)

(58) Field of Classification Search
CPC ..... G03G 15/2028; G03G 15/2075; G03G 15/2064; G03G 15/2085; G03G 2215/2035; G03G 2215/2041
See application file for complete search history.

(56) References Cited

U.S. PATENT DOCUMENTS

2001/0019676 A1* 9/2001 Okubo ..... G03G 15/2064 399/328
2002/0034406 A1* 3/2002 Kawagoe ..... G03G 15/1605 399/302
2003/0170054 A1* 9/2003 Suzuki ..... G03G 15/2064 399/328
2005/0105941 A1* 5/2005 Usui ..... G03G 15/2064 399/328
2005/0191097 A1* 9/2005 Yoshida ..... G03G 15/2064 399/329
2009/0092424 A1* 4/2009 Kim ..... G03G 15/2064 399/329
2012/0107029 A1* 5/2012 Moon ..... G03G 15/2028 399/329

(Continued)

FOREIGN PATENT DOCUMENTS

JP 2005092080 A 4/2005
JP 4320234 B2 8/2009

*Primary Examiner* — Sevan A Aydin
(74) *Attorney, Agent, or Firm* — Fitzpatrick, Cella, Harper & Scinto

(57) ABSTRACT

A fixing apparatus includes a heating rotating member, a nip portion forming member, and a pressure member which, together with a first surface of the nip portion forming member, sandwiches the heating rotating member to form a nip portion. A plurality of grooves is provided on the first surface of the nip portion forming member, so that a size of an area in which the first surface of the nip portion forming member is in contact with the heating rotating member in an upstream area of the nip portion is less than a size of the area in a downstream area of the nip portion with respect to a center of the nip portion in a rotation direction of the heating rotating member. In addition, each groove of the plurality of grooves extends in a direction crossing the rotation direction of the heating rotating member.

5 Claims, 11 Drawing Sheets

(56) References Cited

U.S. PATENT DOCUMENTS

| | | | | |
|---|---|---|---|---|
| 2013/0189007 | A1* | 7/2013 | Ohtsu | G03G 15/206 399/329 |
| 2014/0294465 | A1* | 10/2014 | Hazeyama | G03G 15/2017 399/329 |
| 2014/0369726 | A1* | 12/2014 | Soeda | G03G 15/2053 399/329 |
| 2015/0030362 | A1* | 1/2015 | Bae | G03G 15/2085 399/329 |
| 2015/0093167 | A1* | 4/2015 | Hazeyama | G03G 15/2053 399/329 |
| 2016/0274518 | A1* | 9/2016 | Akatsuka | G03G 15/2085 |
| 2016/0274519 | A1* | 9/2016 | Lim | G03G 15/2053 |
| 2017/0131664 | A1* | 5/2017 | Utsunomiya | G03G 15/2025 |

* cited by examiner

J
N in
N 1
N 2
N out
x
y
z

*FIG. 8*

| COUNTERSUNK SHAPE | CONTACT AREA SIZE RATE ENTIRE FIXING EXTERNAL SURFACE NIP N (AREA N1, AREA N2) |
|---|---|
| NO COUNTERSUNK PORTION | 100% (100%, 100%) |
| FIG. 3 LONGITUDINAL DIRECTION GROOVES × 3 | 75% (50%, 100%) |
| FIG. 6A LONGITUDINAL DIRECTION GROOVES × 5 | 58% (50%, 67%) |
| FIG. 6B LONGITUDINAL DIRECTION GROOVES × 3 + DIAGONAL DIRECTION GROOVES | 58% (17%, 100%) |
| FIG. 6C CIRCULAR GROOVES | 84% (69%, 100%) |

FIXING APPARATUS AND IMAGE FORMING APPARATUS

BACKGROUND OF THE INVENTION

Field of the Invention

The present invention relates to a fixing apparatus having a heating unit for heating a recording material by using a cylindrical rotating member having flexibility, and relates to an image forming apparatus having this fixing apparatus.

Description of the Related Art

Image forming apparatuses based on an electrophotographic system include an apparatus for fixing a toner image onto a recording material by heating and pressurizing the toner image formed on the recording material.

FIG. 11 illustrates an example. An example of this fixing apparatus includes, for example, what is described in the publication of Japanese Patent Laid-Open No. 2005-92080. This includes a cylindrical fixing belt 201 having flexibility (cylindrical rotating member), a halogen heater 202 serving as a heating unit, a fixing member 203 (sliding member), and a pressure roller 204 serving as a pressure member. The fixing belt 201 is driven and rotated according to rotation of the pressure roller 204. The fixing member 203 is fixed inside of the fixing belt 201, and forms a nip between the fixing member 203 and the pressure roller 204.

The recording material 206 is conveyed from the right side of FIG. 11, and the toner is fixed in the nip. The halogen heater 202 heats the fixing belt 201 with radiant heat, but in order to efficiently provide heat to the fixing belt 201 without giving heat to the fixing member 203, a reflection member 205 is installed at the position between the halogen heater 202 and the fixing member 203. Such fixing method is characterized in having superior power saving performance since the heat capacity is low.

However, in this configuration, there is a movement of heat from the fixing belt 201 to the fixing member 203, and because of this movement of heat, it is difficult to increase the temperature of the fixing belt 201, and there is a problem in that the fixing apparatus cannot be started in a short time.

SUMMARY OF THE INVENTION

According to a first aspect of the present invention, a fixing apparatus comprises a heating rotating member having a cylindrical shape, a nip portion forming member which includes a first surface and a second surface opposite to the first surface, and which is provided in a hollow portion of the heating rotating member so that the first surface faces an inner surface of the heating rotating member, and a pressure member which, together with the first surface of the nip portion forming member, sandwiches the heating rotating member to form a nip portion, wherein the nip portion is a contact area between the pressure member and an external surface of the heating rotating member, and a recording material is conveyed at the nip portion, wherein a recording material on which an image is formed is heated while being conveyed at a nip portion, and the image is fixed on the recording material, and wherein a plurality of recessed portions is provided on the first surface of the nip portion forming member, so that an area size where the first surface of the nip portion forming member is in contact with the heating rotating member is smaller in an upstream area of the nip portion than in a downstream area of the nip portion with respect to a center of the nip portion in a rotation direction of the heating rotating member.

Further features of the present invention will become apparent from the following description of exemplary embodiments (with reference to the attached drawings).

BRIEF DESCRIPTION OF THE DRAWINGS

FIG. 8 is a table for relatively comparing contact area size rates according to the embodiment and a modification in FIGS. 3A and 3B and FIGS. 6A and 6B, as compared to the contact area size rate in the example without any countersunk hole.

DESCRIPTION OF THE EMBODIMENTS

Figure 1:
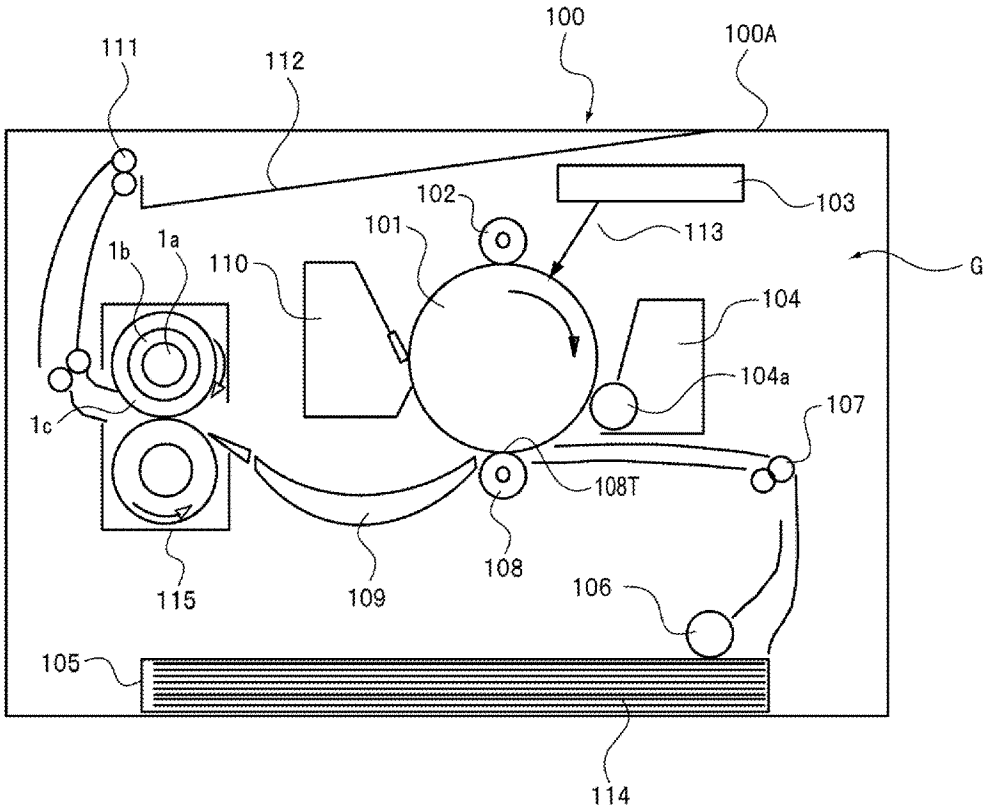
FIG. 1 is a schematic configuration diagram illustrating an image forming apparatus using a fixing apparatus according to the present embodiment.

Hereinafter, modes for carrying out this invention will be described in details in an exemplary manner on the basis of embodiments with reference to drawings. However, a size, a material, a shape, and a relative position of components described in the embodiments may be changed as necessary in accordance with the configuration and various conditions of the apparatus to which the invention is applied, and therefore, it is to be understood that, unless otherwise specifically described, the scope of the invention is not be limited thereto. In a configuration of a later embodiment, the same constituent elements as those of a previous embodiment are denoted with the same reference numerals of the previous embodiment, so that the explanations in the previous embodiment are considered to be incorporated therein by reference.

[First Embodiment]

<The Entire Configuration of Image Forming Apparatus>

FIG. 1 is a schematic configuration diagram of an image forming apparatus 100 using a fixing apparatus 115 according to the present embodiment. The image forming apparatus 100 is a laser beam printer of an electrophotographic system. The image forming apparatus 100 includes an apparatus main body 100A. A photosensitive drum 101 serving as an image bearing member, a charging roller 102, a laser beam scanner 103, and a developing apparatus 104 are arranged inside of the apparatus main body 100A. An image forming portion G for forming an image includes the photosensitive drum 101, the charging roller 102, the laser beam scanner 103, the developing apparatus 104, and the fixing apparatus 115.

The photosensitive drum 101 is rotated and driven at a predetermined process speed (circumferential velocity) in a clockwise direction indicated by an arrow. The photosensitive drum 101 is charged in charging processing in a uniform manner to attain a predetermined polarity and potential with the charging roller 102 in its rotation process.

The laser beam scanner 103 serving as an image exposure unit outputs laser light 113 which is ON-OFF modulated in accordance with a digital pixel signal received from an external device such as a computer, not illustrated, and scans and exposes a charging processing surface of the photosensitive drum 101. With this scanning and exposure, an electrical charge on an exposure bright portion of the surface of the photosensitive drum 101 is removed, and an electrostatic latent image corresponding to image information is formed on the surface of the photosensitive drum 101.

The developing apparatus 104 receives a developer (toner) onto the surface of the photosensitive drum 101 from the developing roller 104*a*, so that the electrostatic latent image on the surface of the photosensitive drum 101 has been developed successively as toner images which are transferrable images.

A cassette 105 accommodates recording materials 114. A feeding roller 106 is driven on the basis of a feeding start signal, and the recording materials 114 in the cassette 105 are separated and fed sheet by sheet. Then, the recording material 114 is introduced with predetermined timing by way of a pair of registration rollers 107 into a transfer portion 108T which is a contact nip portion between the photosensitive drum 101 and a transfer roller 108 driven and rotated by coming into contact with the photosensitive drum 101. More specifically, the pair of registration rollers 107 controls the conveying operation of the recording material 114 so that the leading edge portion of the toner image on the photosensitive drum 101 and the leading edge portion of the recording material 114 reach the transfer portion 108T at the same time.

Thereafter, the recording material 114 is sandwiched and conveyed in the transfer portion 108T, during which time a transfer bias application power supply, not illustrated, applies a transfer voltage (transfer bias), which is controlled to attain a predetermined voltage, to the transfer roller 108. A transfer bias having a polarity opposite to the toner is applied to the transfer roller 108, and at the transfer portion 108T, the toner image at the surface side of the photosensitive drum. 101 is electrostatically transferred to the surface of the recording material 114.

The recording material 114 having the toner image transferred thereon is separated from the surface of the photosensitive drum 101, and passes through a conveying guide 109 to be introduced into the fixing apparatus 115 serving as a heating apparatus. In the fixing apparatus 115, the recording material 114 is subjected to thermal fixing processing of the toner image.

On the other hand, after the toner image is transferred onto the recording material 114, a cleaning apparatus 110 removes transfer residual toner and paper particles from the surface of the photosensitive drum 101, so that the surface of the photosensitive drum 101 is made into a clean surface, and so that the photosensitive drum 101 is capable of being repeatedly used for image formation. The recording material 114 having passed through the fixing apparatus 115 is discharged from a discharge port 111 to a discharge tray 112.

<Fixing Apparatus>

A fixing sleeve (fixing film) 1 serving as a cylindrical rotating member as illustrated in FIG. 1 is in a cylindrical shape having a diameter of 30 mm, and includes a base layer 1*a*, an elastic layer 1*b* stacked on an external surface thereof, and a separation layer 1*c* stacked on an external surface thereof. The material of the base layer 1*a* is a metal material such as SUS and nickel, and a heat-resistant resin material such as polyimide and polyamide-imide, and the thickness of the base layer 1*a* can be about 30 μm to 130 μm so that the base layer 1*a* has flexibility without being torn.

In the configuration according to the present embodiment, SUS having a thickness 50 μm is employed as the base layer 1*a*. The material of the elastic layer 1*b* can be made of a material having a high heat-resistance, and the elastic layer 1*b* has a thickness 50 μm to 150 μm, and is made of silicone rubber or fluorine rubber. The separation layer 1*c* is made of PFA tube having a thickness of about 50 μm.

Figure 2:
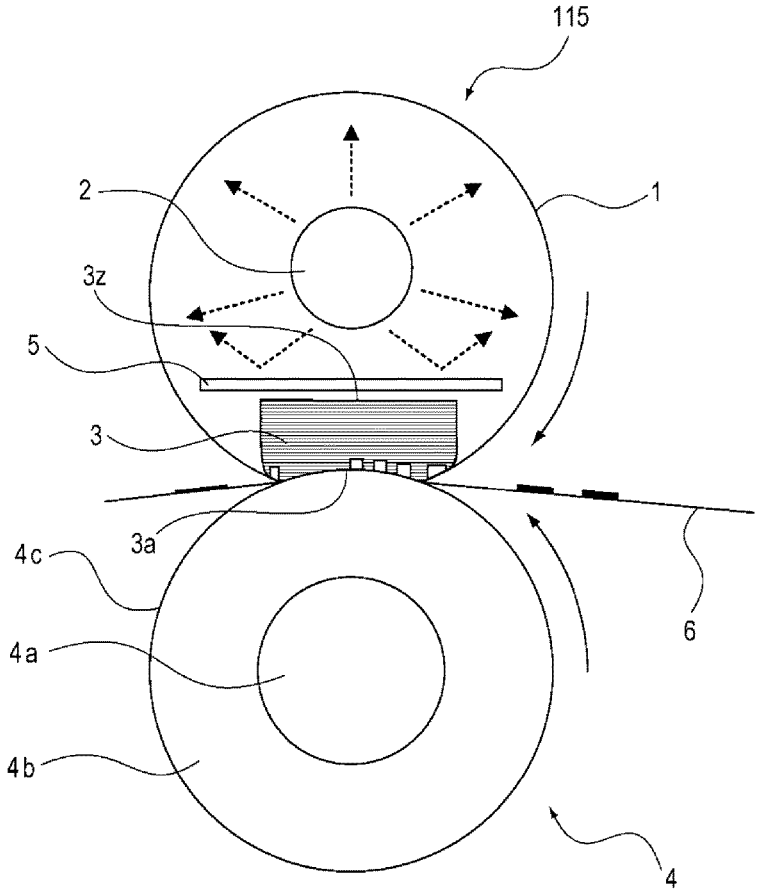
FIG. 2 is a cross-sectional view illustrating the fixing apparatus.

FIG. 2 is a cross sectional view illustrating the fixing apparatus 115. The fixing apparatus 115 includes the fixing sleeve 1 serving as a heating rotating member formed in a cylindrical shape and is capable of rotating, and a sliding member 3 coming into contact with, inside of the fixing sleeve 1, an inner surface of the fixing sleeve 1. The sliding member 3 includes a sliding member surface (first surface) 3*a* facing the inner surface of the fixing sleeve 1 and a surface 3*z* (second surface) at a side opposite thereto. The fixing apparatus 115 includes a pressure roller 4 disposed at a position facing the sliding member surface 3*a* of the sliding member 3 with the fixing sleeve 1 interposed therebetween, and serving as a pressure member for pressurizing the fixing sleeve 1. The sliding member 3 plays a role of a nip portion forming member for working together with the pressure roller 4 to form the fixing nip with the fixing sleeve 1 interposed therebetween.

The halogen heater 2 serving as a heating unit for increasing the temperature of the fixing sleeve 1 is disposed inside of the fixing sleeve 1. The fixing sleeve 1 is heated by radiant heat generated by the halogen heater 2. The radiant heat of the halogen heater 2 should not be radiated to portions other than the fixing sleeve 1 in order to efficiently heat the fixing sleeve 1 with the radiant heat of the halogen heater 2. Therefore, a reflection plate 5 is provided between the sliding member 3 and the halogen heater 2. This reflection plate 5 is made of heat-resistant resin, and has metal deposited on the reflection surface in order to increase the reflection rate of radiation.

The pressure roller 4 serving as the pressure member includes a cored bar 4*a* and an elastic layer 4*b* having heat-resistant property such as silicone rubber, fluorine rubber, and fluorine resin formed around the cored bar 4*a* to cover the cored bar 4*a* in a coaxial manner, and is provided with a separation layer 4*c* on a surface layer thereof. A material having a high separation property and a high heat-resistant property such as PFA, PTFE, and FEP is selected for the separation layer 4*c*.

Both end portions of the cored bar 4*a* are held and arranged so as to be able to rotate with bearings. The pressure roller 4 rotates in a counterclockwise direction of FIG. 2 by a driving unit, not illustrated. With a heating mechanism, not illustrated, the sliding member 3 is pressed in the direction of the pressure roller 4, so that the fixing nip is formed. Therefore, with the rotation of the pressure roller 4, the fixing sleeve 1 is also rotated accordingly.

The sliding member 3 is required to have a heat-resistant property, a sliding property, and a low heat conductivity. Therefore, in the configuration according to the present embodiment, the sliding member 3 employs PPS resin (Poly Phenylene Sulfide) as its material. However, the material of the sliding member 3 is not limited to PPS resin. Other heat-resistant resins or metals may be employed. The shape of the sliding member 3 will be described below in detail.

<Surface Shape of Sliding Member>

Figure 3A:
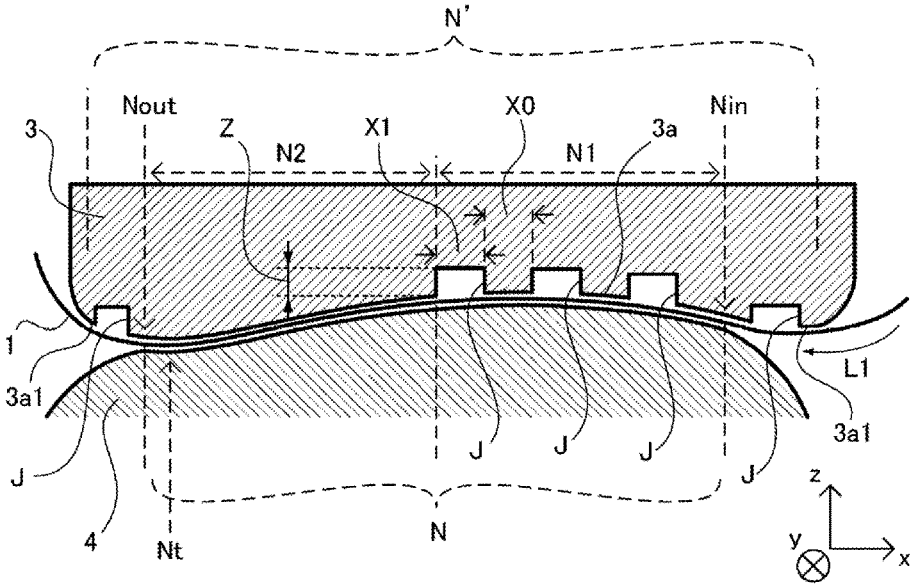
FIGS. 3A and 3B are schematic diagrams for illustrating a surface shape of a sliding member around a fixing nip.
Figure 3B:
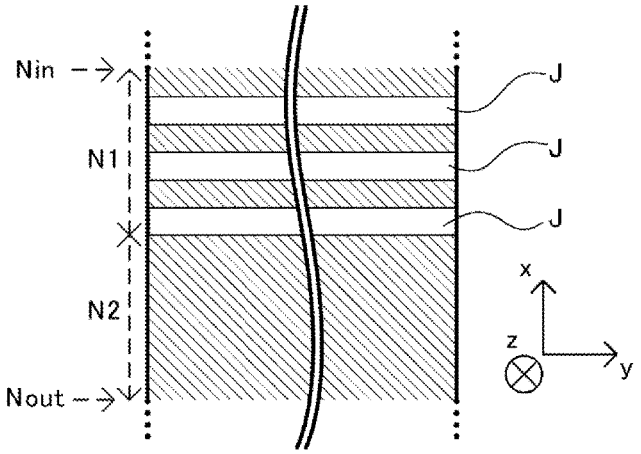

FIGS. 3A and 3B are schematic diagrams for explaining the surface shape of the sliding member 3 close to the fixing nip. FIG. 3A is a schematic diagram of the sliding member 3 in a cross-sectional direction. The fixing nip includes two types, i.e., a fixing external surface nip N which is an area in which the fixing sleeve 1 and the pressure roller 4 are in contact with each other, and a fixing inner surface nip N' which is an area in which the fixing sleeve 1 and the sliding member 3 are in contact with each other.

In a case in which the length of the fixing external surface nip N is longer than the length of the fixing inner surface nip N', the following problems may occur. A pressure locally increases at an edge portion of the sliding member 3 at the upstream side in the conveying direction of the recording material, and this accelerates abrasion of the sliding member 3. Since cut powders generated at that moment are interposed at the fixing nip, this may make it difficult for the fixing sleeve 1 to rotate, and as a result, the torque of the pressure roller 4 may increase. Therefore, the fixing inner surface nip N' can be longer than the fixing external surface nip N. In the configuration according to the present embodiment, the length of the fixing external surface nip N is 11 mm, and the length of the fixing inner surface nip N' is 14 mm.

In the fixing external surface nip N, an area of the sliding member surface 3*a* at the upstream side in the rotation direction of the fixing sleeve 1 will be denoted as an area N1, and an area at the downstream side will be denoted as an area N2. In the configuration according to the present embodiment, countersunk holes J are provided in the area N1, a countersunk hole width X1 is 0.9 mm, a non-countersunk hole width X0 is 0.9 mm, and a countersunk hole depth Z is 0.5 mm. In this case, the countersunk hole J means a recessed portion having a bottom. In the present embodiment, multiple recessed portions are formed in the sliding member surface 3*a*. In the area N1 of the contact area (fixing inner surface nip N') in which the fixing sleeve 1 and the sliding member 3 are in contact with each other, the sliding member surface 3*a* serves as a portion in which an uneven shape is formed on the surface of the sliding member 3, and the fixing sleeve 1 and the sliding member 3 are locally in contact with each other. The sliding member surface 3*a* is a surface facing the inner surface of the fixing sleeve 1, and is a curved surface that is in a shape protruding in a direction away from the pressure roller 4. Instead of the countersunk holes J formed in the recessed portion having the bottom, the portion of the recessed portion may be configured to be a penetration hole.

Therefore, a contact area size rate at the contact area (fixing inner surface nip N') in which the fixing sleeve 1 and the sliding member 3 are in contact with each other is smaller in the area N1 at the upstream in the rotation direction L1 of the fixing sleeve 1 than in the area N2 at the downstream. A contact area size rate at the contact area (fixing external surface nip N) in which the fixing sleeve 1 and the pressure roller 4 are in contact with each other is smaller in the area N1 at the upstream of in the rotation direction L1 of the fixing sleeve 1 than in the area N2 at the downstream.

The optimum value in the countersunk hole width X1 changes in accordance with the rigidity and the pressure force of the fixing sleeve 1. More specifically, when the size of the countersunk hole width X1 is increased excessively, the fixing sleeve 1 follows the inside of the countersunk hole J to lose pressure, and an image failure occurs so that an image on the recording material 6 is scraped before it is fixed. Therefore, it is necessary to set the countersunk hole width X1 so that such image failure does not occur.

In the configuration according to the present embodiment, the countersunk hole portion and the non-countersunk hole portion are repeated in a regular manner, but it may not be necessarily in a regular manner. For example, the countersunk hole width X1 may be increased in a portion in which the pressure is lower in the area N1.

In the configuration according to the present embodiment, the countersunk holes J are provided in the area within the fixing inner surface nip N' but not included in the fixing external surface nip N. In a non-contact area Y in which the fixing sleeve 1 and the pressure roller 4 are not in contact with each other in the contact area (fixing inner surface nip N') in which the fixing sleeve 1 and the sliding member 3 are in contact with each other, there is a sliding member surface 3*a*1 serving as a portion in which an uneven shape is formed on the surface of the sliding member 3*a*, and the fixing sleeve 1 and the sliding member 3 are locally in contact with each other.

In this area, pressure is not applied from the pressure roller 4, and this area is an area in which contact with the sliding member 3 is made by rigidity of the fixing sleeve 1. Therefore, the pressure is low, and even if a countersunk hole J is provided in this area, the image failure is less likely to occur, and therefore, a larger countersunk hole J than those in the fixing nip N can be attached.

FIG. 3B is a schematic diagram of an area of the sliding surface 3*a* included in the fixing external surface nip N of the sliding member 3. As illustrated in the drawing, in the configuration according to the present embodiment, countersunk holes J have a constant width, and extend in a straight line shape in y-axis direction. More specifically, in the present embodiment, long and narrow grooves extending in the longitudinal direction of the fixing sleeve 1 include multiple countersunk hole portions arranged in the rotation direction L1 of the fixing sleeve 1. Since the countersunk hole width X1 is small, the fixing sleeve 1 does not follow the countersunk hole shape, and in the portion where there are countersunk holes J, the fixing sleeve 1 does not come into contact with the sliding member 3.

Therefore, this suppresses transfer of heat from the fixing sleeve 1 to the sliding member 3, so that the fixing apparatus 115 can be started in a short time. When the countersunk holes J according to the present embodiment are provided, the startup speed can be increased by about 10% as compared with a conventional configuration having no countersunk hole J. However, a shape other than that described above may be employed as the shape of the countersunk hole J, and the type of the countersunk hole shape will be described later in detail.

Hereinafter, the reason why providing many countersunk holes J in the area N1 than in the area N2 is effective for suppressing thermal transfer from the fixing sleeve 1 to the sliding member 3 will be described in detail.

Figure 4A:
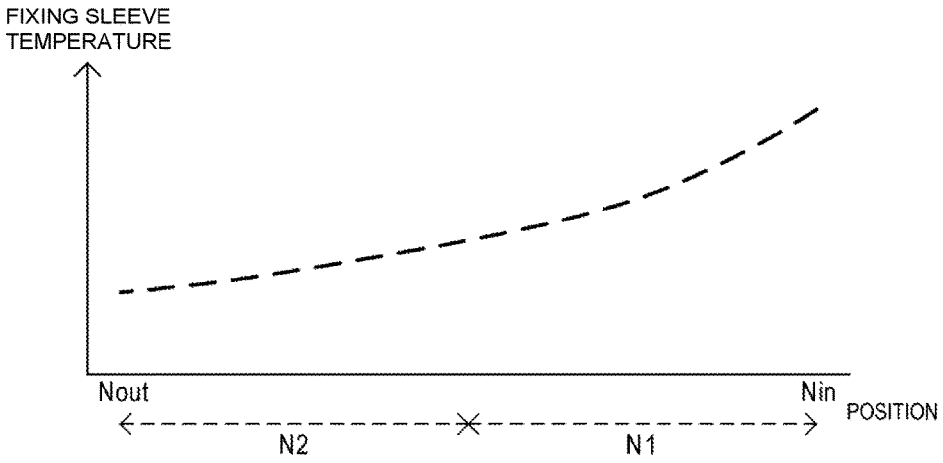
FIG. 4A is a graph illustrating a temperature distribution of a fixing sleeve in a fixing external surface of the nip.

FIG. 4A is a graph illustrating a temperature distribution of the fixing sleeve 1 in the fixing external surface nip N. In FIG. 4A, the right side is a rotation upstream side of the fixing sleeve 1. The fixing sleeve 1 is mainly heated at the side opposite to the fixing external surface nip N by the halogen heater 2.

In the fixing external surface nip N, heat is transferred from the fixing sleeve 1 to the pressure roller 4, to the recording material 6, and to the sliding member 3. For this reason, in the contact area (fixing external surface nip N) in which the fixing sleeve 1 and the pressure roller 4 are in contact with each other, the temperature of the fixing sleeve 1 is higher at an upstream end $N_{in}$ upstream in the rotation direction L1 of the fixing sleeve 1 than at a downstream end $N_{out}$ downstream in the rotation direction L1. Since the amount of thermal transfer due to heat conduction is proportional to the temperature difference, the thermal transfer from the fixing sleeve 1 to the sliding member 3 is larger in the area N1 than in the area N2.

Therefore, the heat can be insulated effectively by providing a greater number of countersunk holes J in the area N1 than in the area N2. Accordingly, in the present embodiment, since the countersunk holes J are provided in the area N1, the pressure distribution in the fixing external surface nip N is rear end pressure. More specifically, the present embodiment employs such a shape that the sliding member 3 is engaged with the pressure roller 4 more deeply at a position of a rear end portion Nt, as illustrated in FIGS. 3A and 3B, than at the other portions in the fixing external surface nip N. In the area N2 at the downstream side in the rotation direction L1 of the fixing sleeve 1, the sliding member 3 has the rear end portion Nt protruding in a direction so as to be closer to the pressure roller 4 than the area N1 at the upstream side.

Figure 4B:
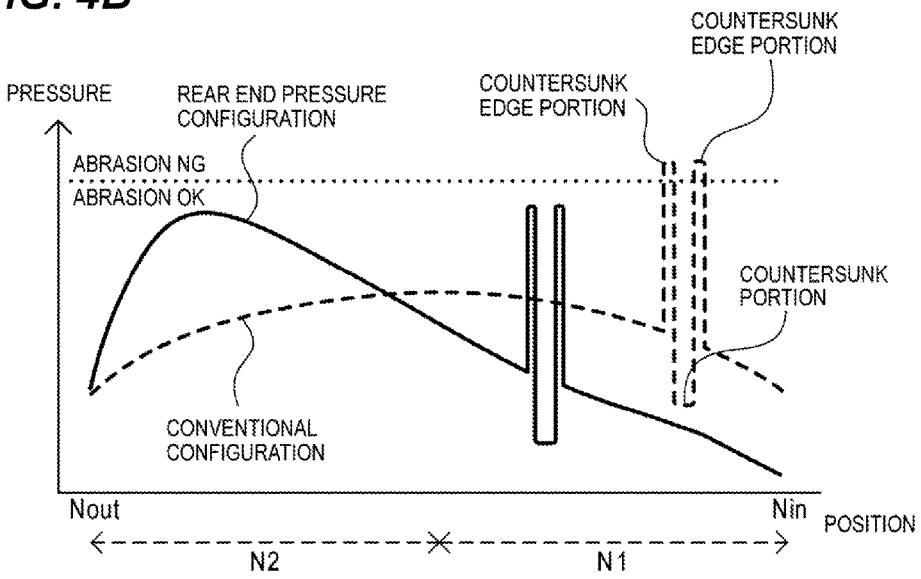
FIG. 4B is a graph illustrating a pressure distribution of a conventional configuration and a rear end pressure configuration in the fixing external surface of the nip.

FIG. 4B is a graph illustrating a pressure distribution of a conventional configuration and a rear end pressure configuration (an engaging configuration of the rear end portion Nt described above) in the fixing external surface nip N. When the pressure is high, abrasion of the sliding member 3 is advanced because of the sliding and scrubbing between the fixing sleeve 1 and the sliding member 3. Since cut powders generated at that moment are interposed at the fixing nip, this may make it difficult for the fixing sleeve 1 to rotate, and as a result, the torque of the pressure roller 4 may increase. At the portion where the countersunk holes J are provided, the pressure locally increases at the edge portion, and therefore, in the conventional configuration, abrasion is advanced no matter what area the countersunk holes J are provided.

However, when the rear end pressure configuration is employed, the pressure of the area N1 is relatively reduced, and therefore, even when the countersunk holes J are provided, the abrasion level does not cause any problem. Therefore, the average value of the pressure in the contact area (fixing external surface nip N) where the fixing sleeve 1 and the pressure roller 4 are in contact with each other is lower in the area N1 at the upstream in the rotation direction L1 of the fixing sleeve 1 than in the area N2 at the downstream.

Therefore, with the rear end pressure configuration of the countersunk holes J in the area N1, while the abrasion of the sliding member 3 is suppressed, the thermal transfer from the fixing sleeve 1 to the sliding member 3 can be effectively suppressed.

Figure 5:
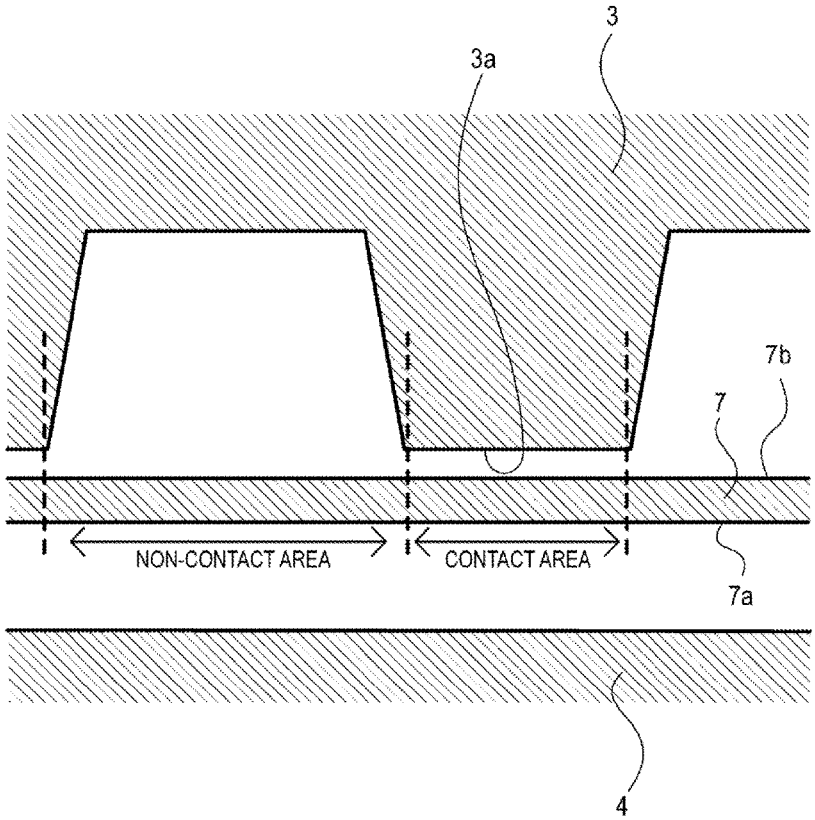
FIG. 5 is a cross sectional view at a countersunk hole portion.

FIG. 5 is a cross-sectional view at a countersunk hole portion. The contact area size rate is defined as follows in order to define the countersunk hole quantity.

[Math 1]

$$\text{contact area size ratio } [\%] = \frac{\text{contact area size}}{\text{contact area size} + \text{non-contact area size}} \times 100 \quad (1)$$

The contact area and the non-contact area are defined in the following measurement. A polyimide tape 7 is adhered to the sliding member surface 3*a* while a tension is appropriately maintained. At this occasion, a shape with which the fixing sleeve 1 comes into contact with the sliding member 3 in the fixing apparatus 115 is reproduced by applying pressure with the pressure roller 4. Thereafter, the pressure roller 4 is separated, and a shape measurement of the polyimide tape surface 7*a* is performed with a measurement device such as a laser microscope. A shape of the polyimide tape adhesion surface 7*b* can be calculated by considering the thickness of the polyimide tape 7.

The polyimide tape adhesion surface 7*b* corresponds to the back surface of the fixing sleeve 1, and therefore, the sliding member 3 at the position of the polyimide tape adhesion surface 7*b* is considered to be in contact with the fixing sleeve 1. As described above, the contact area size rate can be calculated by obtaining the contact area and the non-contact area as described above.

<Countersunk Hole Shape and Startup Time>

Figures 6A, 6B, 6C:
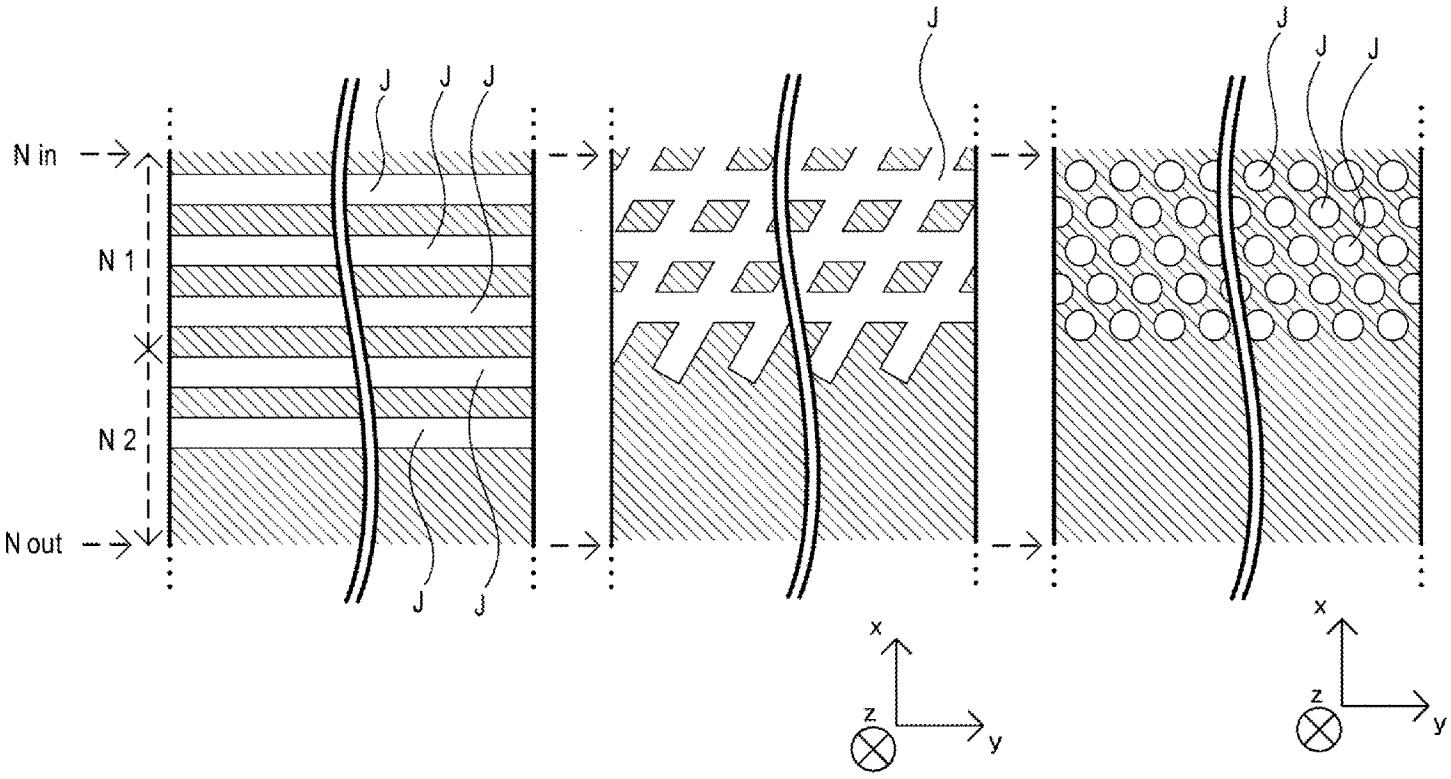
FIGS. 6A to 6C are top views illustrating a modification of a sliding member.
Figure 7:
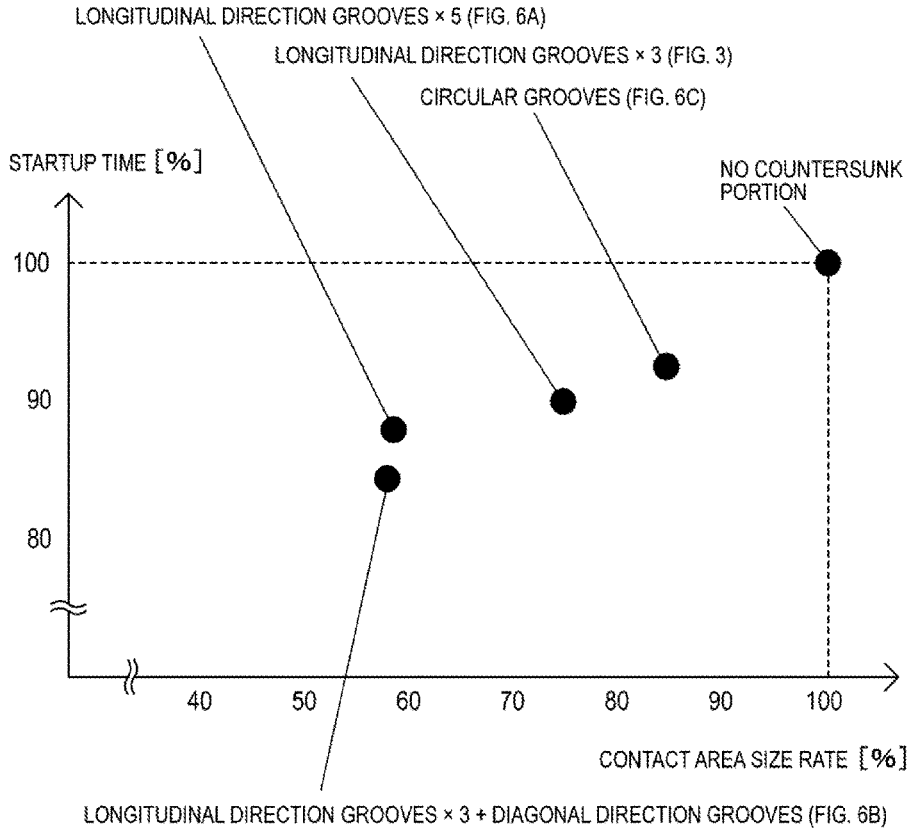
FIG. 7 is a graph for relatively comparing startup times with respect to contact area size rates according to the embodiment and a modification in FIGS. 3A and 3B and FIGS. 6A and 6B, as compared to the startup time in the example without any countersunk hole.

In the present embodiment, the countersunk hole shape is as illustrated in FIGS. 3A and 3B, but the same effects can also be obtained from the other shapes. In order to check startup times based on different countersunk hole shapes, the effects are confirmed based on different countersunk hole shapes as illustrated in FIGS. 6A to 6C. FIG. 7 is a graph for relatively comparing startup times with respect to contact area size rates according to the embodiment and a modification in FIGS. 3A and 3B and FIGS. 6A to 6C, as compared to the startup time in the example without any countersunk hole J. FIG. 8 is a table for relatively comparing contact area size rates according to the embodiment and a modification in FIGS. 3A and 3B and FIGS. 6A to 6C, as compared to the contact area size rate in the example without any countersunk hole J.

In the case of longitudinal direction grooves (three grooves), which is the configuration according to the present embodiment, the startup time is faster by about 10% as compared with the conventional case without any countersunk hole J (see FIG. 7). In the case in which the number of grooves is further increased (FIG. 6A), the reduction in the contact area size rate is large, but the startup time is not reduced so greatly (see FIG. 7). This indicates that, as described above, the temperature of the fixing sleeve 1 in the fixing external surface nip N is decreased, and therefore, the effect is smaller.

Subsequently, when a case in which countersunk holes J are increased not only in the longitudinal direction but also in a direction of 30 degrees from the conveying direction (the rotation direction L1) (FIG. 6B) is checked, this indicates that the effect for the startup time is greater (see FIG. 7). The reason for this is as described above, but since the countersunk holes J are put in the area N1, the startup time is considered to have been reduced. When countersunk holes J are provided in the conveying direction (the rotation direction L1), a particular portion in the longitudinal direction of the fixing sleeve 1 is scrubbed and abraded at the edge portion of countersunk holes J for a long period of time, and therefore, it is preferable to apply some angle from the conveying direction (the rotation direction L1).

A circle can also be considered as a countersunk hole shape (FIG. 6C). A pattern other than the above countersunk hole shape can also be considered, and the contact area size rate can also be reduced by wrapping the sliding member surface 3*a* in addition to providing the countersunk holes J. However, when the contact area size rate is reduced excessively, this may affect abrasion of the fixing sleeve 1 and the sliding member 3, and therefore, it is necessary to consider a balance with the startup time.

As described above, in the fixing apparatus 115 according to the present embodiment, countersunk hole processing is provided in the sliding member surface 3*a*. At this occasion, thermal supply from the fixing sleeve 1 to the sliding member 3 is suppressed by increasing the countersunk hole quantity at the upstream side, and as a result, the startup speed of the fixing apparatus 115 can be increased.

The halogen heater 2 is employed as the heating unit in the configuration according to the present embodiment, but any heating method may be used as the heating unit as long as it is a method for heating the fixing sleeve 1 without relying on the fixing nip portion.

[Second Embodiment]

Hereinafter, the configuration according to the second embodiment will be described. In the present embodiment, the sliding member 3 according to the first embodiment is made into two bodies, i.e., a sliding member 8 and a sliding portion holding member 9. Therefore, explanations about the configuration other than the sliding member 8 and the sliding portion holding member 9 will not be described.

Figure 9:
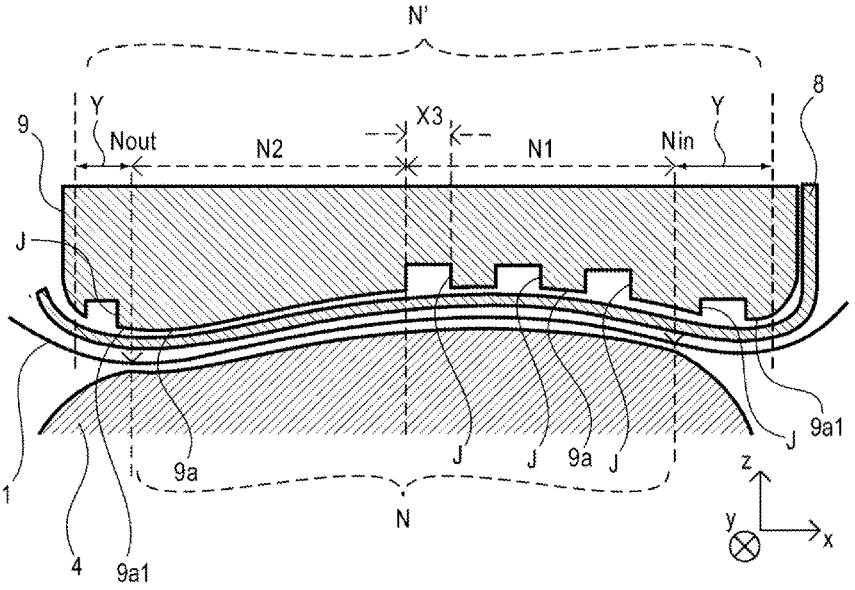
FIG. 9 is an expanded cross-sectional view illustrating a fixing nip portion according to a second embodiment.

FIG. 9 is an expanded cross-sectional view illustrating a fixing nip portion according to the second embodiment. The sliding member 8 comes into contact with the fixing sleeve 1 inside of the fixing sleeve 1. The sliding member 8 is constituted by a material having a high thermal transfer property, a heat-resistant property, and a sliding property. Since the sliding member 8 has the high thermal transfer property, this makes an effect of dispersing heat when a small-size sheet is fed and the fixing sleeve 1 is abnormally heated in a non-sheet feeding portion area. On the other hand, the sliding member 8 deprives heat from the fixing sleeve 1, and therefore, it preferably has a low heat capacity, and a metal material having thickness is about 0.1 mm to 1.0 mm, such as aluminum, can be employed. In the configuration according to the present embodiment, aluminum having a thickness of 0.5 mm is employed as the sliding member 8.

The sliding portion holding member 9 is arranged at the position facing the fixing sleeve 1 with the sliding member 8 interposed therebetween, so that the sliding member 8 is fixed. The sliding portion holding member 9 is a member for backing up a thin sliding member 8, and therefore, the sliding portion holding member 9 needs to have a heat-resistant property, and have a low thermal transfer property so that the heat is not transmitted. In the configuration according to the present embodiment, PPS resin is employed as the sliding portion holding member 9.

In this configuration, there is some heat transfer from the fixing sleeve 1 to the sliding member 8, but since the heat capacity of the sliding member 8 is small, the temperature suddenly rises, and the heat transfer from the fixing sleeve 1 to the sliding member 8 is converged. Therefore, in order to start the fixing apparatus 115 in a short time, it is necessary to suppress heat transfer from the sliding member 8 to the sliding portion holding member 9.

In the configuration according to the present embodiment, countersunk holes J are provided on a holding member surface 9*a*. The size of a countersunk hole width X3 can be set to a relatively large size with respect to the countersunk hole width X1 according to the first embodiment. In the first embodiment, since the fixing sleeve 1 follows the inside of the countersunk hole J, the countersunk hole width X1 cannot be enlarged, but in the configuration according to the present embodiment, the sliding member 8 is configured to receive a pressure force from the pressure roller 4. Therefore, the countersunk hole width X3 may be determined within a range in which the sliding member 8 is not deformed and the pressure distribution in the fixing nip does not change.

As a result, the countersunk hole quantity can be more than that of the first embodiment. In the configuration according to the present embodiment, 1.0 mm is employed as the countersunk hole width X3. For the same reason as in the first embodiment, in the area N2, it is necessary to decrease the number of countersunk holes J as compared with the area N1. Therefore, in the configuration according to the present embodiment, countersunk holes J are not provided in the area N2. The contact area size rate between the sliding member 8 and the sliding portion holding member 9 is smaller in the area N1 serving as an "upstream portion" upstream in the rotation direction L1 of the fixing sleeve 1 than in the area N2 serving as a "downstream portion" downstream in the rotation direction L1 of the fixing sleeve 1. Accordingly, the startup speed can be increased by about 10% as compared with a conventional configuration.

In the contact area (fixing inner surface nip N') where the sliding member 8 and the sliding portion holding member 9 are in contact with each other, the holding member surface 9*a* serves as a "portion" in which an uneven shape is formed on the surface of the sliding portion holding member 9 and in which the sliding member 8 and the sliding portion holding member 9 are "locally in contact with each other". In the contact area (fixing inner surface nip N') in which the fixing sleeve 1 and the sliding member 8 are in contact with each other, there is a portion described below in the non-contact area Y where the fixing sleeve 1 and the pressure roller 4 are not in contact with each other. More specifically, a holding member surface 9*a*1 serves as a "portion" in which an uneven shape is formed on the surface of the sliding portion holding member 9 and in which the sliding portion holding member 9 and the sliding member 8 "are locally in contact with each other".

As described above, in the fixing apparatus 115 according to the present embodiment, two bodies are provided, i.e., the sliding member 8 and the sliding portion holding member 9, and the countersunk hole processing is provided on the sliding portion holding member 9. With the effect of the sliding member 8, as compared with the first embodiment, while an abnormal increase in the temperature at the end portion of the fixing sleeve 1 is suppressed, the heat supply from the sliding member 8 to the sliding portion holding member 9 is suppressed by more greatly increasing the countersunk hole quantity of the sliding portion holding member 9 at the upstream side. As a result, the fixing apparatus 115 can be started in a shorter period of time.

[Third Embodiment]

Hereinafter, the configuration of the third embodiment will be described. However, in the present embodiment, only a sliding member 10 and a sliding portion holding member 11 are different from the configuration of the second embodiment. Therefore, explanation about the configuration other than the sliding member 10 and the sliding portion holding member 11 will be omitted.

Figure 10:
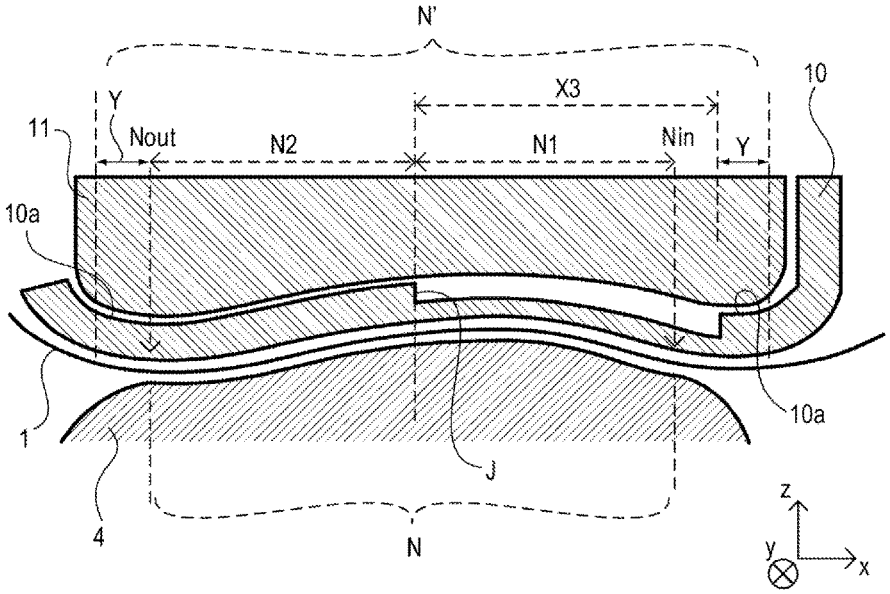
FIG. 10 is an enlarged cross-sectional view illustrating a fixing nip portion according to a third embodiment.
Figure 11:
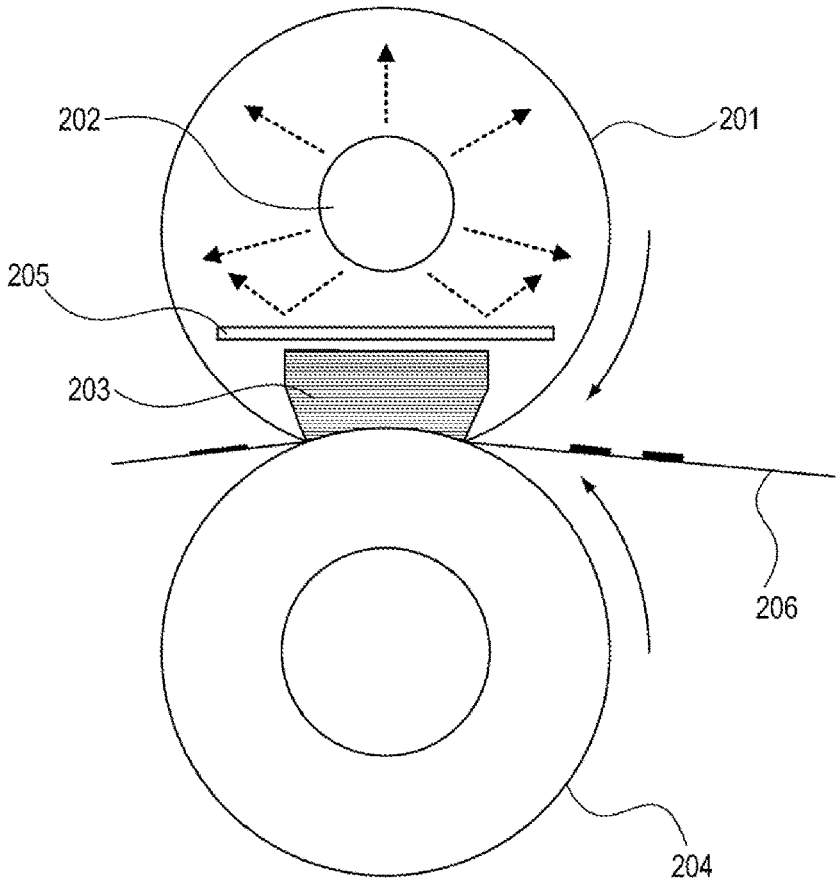
FIG. 11 is a figure for explaining a technique related to Japanese Patent Laid-Open No. 2005-92080.

FIG. 10 is an enlarged cross-sectional view illustrating a fixing nip portion according to the third embodiment. The sliding member 10 is in contact with the fixing sleeve 1 inside of the fixing sleeve 1. Like the sliding member 8 according to the second embodiment, the sliding member 10 is constituted by a material having a high thermal transfer property, a heat-resistant property, and a sliding property. Since the sliding member 10 has the high thermal transfer property, this makes an effect of dispersing heat when a small-size sheet is fed and the fixing sleeve 1 is abnormally heated in a non-sheet feeding portion area. However, in the configuration according to the present embodiment, countersunk holes J are provided on the back surface 10*a* of the sliding member 10 that is in contact with the sliding portion holding member 11. Therefore, it is necessary to have a thickness for ensuring rigidity while a low heat capacity is achieved. In the configuration according to the present embodiment, aluminum of 2.0 mm is employed.

The countersunk hole width X3 needs to be determined because of the reason described in the second embodiment, and in the configuration according to the present embodiment, 6.5 mm is employed. By providing the countersunk holes J, the startup speed of the fixing apparatus 115 can be increased by about 5% as compared with the conventional configuration.

The sliding portion holding member 11 is arranged at the positon facing the fixing sleeve 1 with the sliding member 10 interposed there between, so that the sliding member 10 is fixed. Like the sliding portion holding member 9 according to the second embodiment, the sliding portion holding member 11 is required to have a heat-resistant property and have a low thermal transfer property so that heat is not transmitted. In the configuration according to the present embodiment, PPS resin is employed as the sliding portion holding member 11.

The contact area size rate between the sliding member 10 and the sliding portion holding member 11 is smaller in the area N1 serving as an "upstream portion" upstream in the rotation direction L1 of the fixing sleeve 1 than in the area N2 serving as a "downstream portion" downstream in the rotation direction L1 of the fixing sleeve 1.

In the contact area (fixing inner surface nip N') in which the sliding member 10 and the sliding portion holding member 11 are in contact with each other, there is a sliding member back surface 10*a* serving as a "portion" in which an uneven shape is formed on the back surface of the sliding member 10 and in which the sliding member 10 and the sliding portion holding member 11 "are locally in contact with each other". In the contact area (fixing inner surface nip N') in which the fixing sleeve 1 and the sliding member 10 are in contact with each other, there is a portion described below in the non-contact area Y in which the fixing sleeve 1 and the pressure roller 4 are not in contact with each other. More specifically, like the second embodiment, there may be a portion in which an uneven shape is formed on the back surface of the sliding member 10 and in which the sliding portion holding member 11 and the sliding member 10 are locally in contact with each other.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2015-197957, filed Oct. 5,2015 which is hereby incorporated by reference herein in its entirety.

What is claimed is:

1. A fixing apparatus comprising:

a heating rotating member having a cylindrical shape and having an inner surface;

a nip portion forming member which includes a first surface and a second surface opposite to the first surface, and which is provided in a hollow portion of the heating rotating member so that the first surface faces the inner surface of the heating rotating member; and a pressure member which, together with the nip portion forming member, sandwiches the heating rotating member to form a nip portion, wherein the nip portion is a contact area between the pressure member and an external surface of the heating rotating member, and a recording material is conveyed at the nip portion, wherein a recording material on which an image is formed is heated while being conveyed at the nip portion, and the image is fixed on the recording material, wherein a plurality of grooves is provided on the first surface of the nip portion forming member, so that a size of an area in which the first surface of the nip portion forming member is in contact with the heating rotating member in an upstream area of the nip portion is less than a size of an area in which the first surface of the nip portion forming member is in contact with the heating rotating member in a downstream area of the nip portion with respect to a center of the nip portion in a rotation direction of the heating rotating member, and wherein each groove of the plurality of grooves extends in a direction crossing the rotation direction of the heating rotating member.

2. The fixing apparatus according to claim 1, wherein an average pressure in the upstream area of the nip portion is less than an average pressure in the downstream area of the nip portion.

3. The fixing apparatus according to claim 1, wherein the first surface of the nip portion forming member in the nip portion has a curved shape protruding in a direction away from the pressure member.

4. The fixing apparatus according to claim 1, wherein in a conveying direction of a recording material at the nip portion, both end portions of a contact area of the heating rotating member and the first surface of the nip portion forming member are outside of both end portions of the nip portion.

5. The fixing apparatus according to claim 1, wherein the heating rotating member is a film.

* * * * *